United States Patent [19]

Bennett

[11] 4,351,783

[45] Sep. 28, 1982

[54] COMBUSTION FUEL AND AIR FLOW CONTROL AND MIXER APPARATUS

[76] Inventor: Donald G. Bennett, 1240 N. Kelly Ave., Odessa, Tex. 79760

[21] Appl. No.: 266,709

[22] Filed: May 26, 1981

[51] Int. Cl.[3] ..... F02M 17/16

[52] U.S. Cl. ..... 261/44 E; 261/50 R; 261/89

[58] Field of Search ..... 261/89, 50 R, 44 E; 48/180 S

[56] References Cited

U.S. PATENT DOCUMENTS

| | | | |
|---|---|---|---|
| 633,800 | 9/1899 | Casgrain | 261/89 |
| 680,961 | 8/1901 | Buffum | 261/89 |
| 760,673 | 5/1904 | White et al. | 261/89 |
| 791,801 | 6/1905 | Leinau | 261/89 |
| 806,760 | 12/1905 | Van De Putte | 48/180 R |
| 1,106,258 | 8/1914 | Tucker et al. | 261/89 |
| 1,111,763 | 9/1914 | Rogers | 261/89 |
| 1,211,714 | 1/1917 | Kirbach et al. | 261/89 |
| 1,529,612 | 3/1925 | Assmus | 261/89 |
| 1,731,924 | 10/1929 | Engelke | 261/89 |
| 1,746,439 | 2/1930 | Murrer | 261/89 |
| 2,018,561 | 10/1935 | Lucich | 48/180 S |
| 2,034,430 | 3/1936 | Farrow et al. | 48/180 S |
| 2,211,552 | 8/1940 | Bernstein et al. | 261/89 |
| 3,822,868 | 7/1974 | Carnes | 261/89 |
| 4,014,306 | 3/1977 | Ingersoll | 48/180 S |
| 4,153,028 | 5/1979 | Kumm et al. | 48/180 S |

FOREIGN PATENT DOCUMENTS

| | | | |
|---|---|---|---|
| 101693 | 10/1923 | Switzerland | 261/89 |

*Primary Examiner*—Tim R. Miles

*Attorney, Agent, or Firm*—Marcus L. Bates

[57] ABSTRACT

A housing has a fuel chamber formed therewithin. A fuel flow path is formed to and from the chamber. A plurality of air passageways are formed through the housing. A movable plate member has a plurality of spaced ports formed therein, and is movable from an open to a closed position. In the closed position, the holes in the plate are misaligned with the outlet end of the flow passageways, thereby precluding air flow therethrough; and, when the plate is moved to the open position, the holes in the plate are brought into registry with the passageways, thereby permitting flow of air to occur therethrough. A cam is formed on the plate and reciprocates a valve element respective to a valve seat. The valve is located to control flow from the fuel chamber, through the valve, and through the plate member. The fuel flow control and the air flow control are arranged respective to one another so that a constant ratio of air/fuel is maintained as the fuel valve and the air supply are throttled between the opened and closed positions. A turbine wheel is arranged downstream of the movable plate member. The mass flow of fuel/air causes the turbine to rotate at high speed, thereby intimately mixing the fuel and air.

9 Claims, 9 Drawing Figures

COMBUSTION FUEL AND AIR FLOW CONTROL AND MIXER APPARATUS

BACKGROUND OF THE INVENTION

The combustion mixture supplied to the intake manifold of an internal combustion engine must be of the proper air/fuel ratio as well as being of the proper mass flow in order for the engine to function efficiently. Many different carburetion systems have been proposed over the years, as evidenced by the following prior art patents, to which reference is made for further background of this invention, as well as for providing the known prior art.

It is known that an internal combustion engine can run with great economy by utilizing air admixed with gasoline vapors. It has been found that air traveling along a tortous path through a fuel tank, whereupon a predetermined amount of gasoline in the vapor state is combined with a predetermined flow of air, will provide great economy as contrasted to the use of an oridnary venturi type carburetor. It would, therefore, appear reasonable to expect that maximum fuel economy is achieved when the liquid fuel is completely vaporized and admixed with the combustion air in a precise ratio of fuel and air to form the combustible mixture.

Apparatus which controls the fuel/air ratio and thoroughly admixes the liquid fuel with the combustion air so that only gaseous material flows into the intake manifold of an internal combustion engine is the subject of the present invention.

SUMMARY OF THE INVENTION

The present invention teaches a flow control apparatus having fuel and air passageways formed through a housing. The air passageways have an inlet end spaced from an outlet end, with the outlet ends terminating in a common plane. An apertured movable plate member lies parallel to the plane formed by the outlet ends of the air passageways and can be moved to bring the apertures of the plate member into and out of registry with respect to the outlet ends of the passageways, thereby throttling or controlling the flow of air through the passageways.

A fuel chamber is formed within the housing, and includes an inlet and outlet. A valve means is moved from the closed to the opened position concurrently with the movement of the plate member, so that fuel flow is increased as the mass air flow is increased.

A turbine wheel underlies the apertured plate member so that air flowing thereacross imparts great rotational velocity into the turbine wheel. Accordingly, fuel flow from the fuel valve means contacts the rotating turbine wheel whereupon the fuel is exploded into a vapor, which admixes with the air, thereby providing a mixture of fuel and air wherein the liquid fuel has been completely changed into the vapor state, and the air/fuel ratio is maintained substantially constant over a wide range of flow conditions as the mass flow of air and fuel is changed.

The outlet end of the housing includes mount means by which the housing can be attached to the intake manifold of a combustion apparatus, such as an internal combustion engine of an automobile, for example.

Accordingly, a primary object of the present invention is the provision of a flow control apparatus which intimately mixes a proportionate quantity of liquid fuel and air in such a manner that the resultant mixture is in the gaseous state.

Another object of the present invention is the provision of a flow control apparatus for providing a combustible mixture of fuel and air, wherein the air/fuel ratio is maintained substantially constant as the mass flow is increased from a minimum to a maximum.

A further object of the present invention is the provision of a fuel and air flow controller which admixes a predetermined amount of liquid fuel with a predetermined amount of combustion air, and changes the fuel from the liquid phase to the gaseous phase so that an intimate mixture of air and hydrocarbons of the proper air/fuel ratio results.

These and various other objects and advantages of the invention will become readily apparent to those skilled in the art upon reading the following detailed description and claims and by referring to the accompanying drawings.

The above objects are attained in accordance with the present invention by the provision of a combination of elements which are fabricated in a manner substantially as described in the above abstract and summary.

DETAILED DESCRIPTION OF THE PREFERRED EMBODIMENTS

Figure 1:
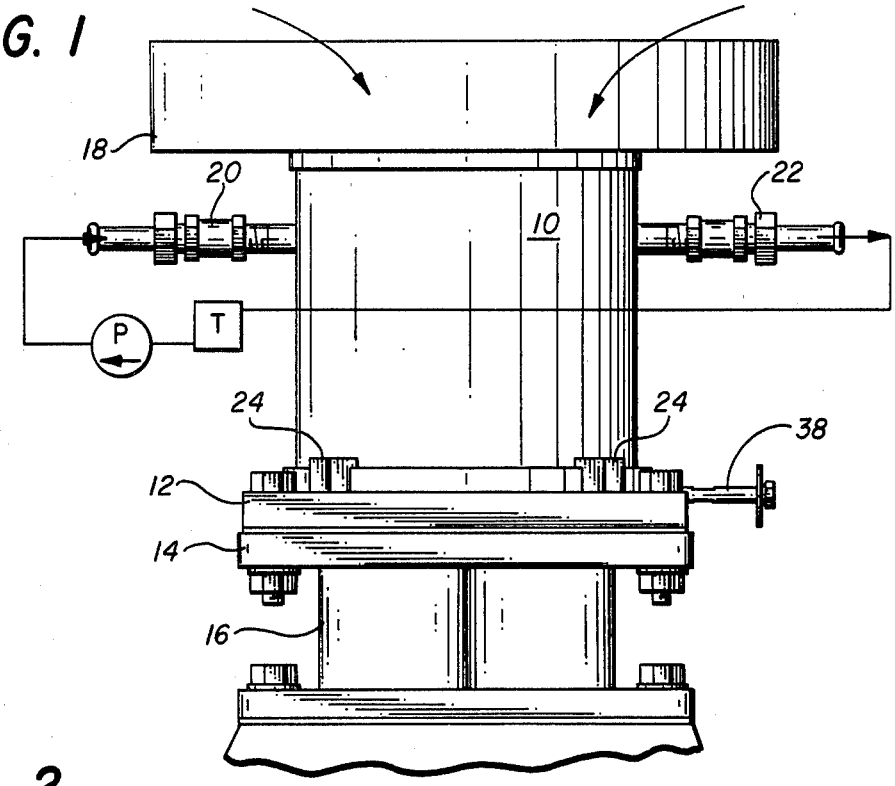
FIG. 1 is a side elevational view of a flow control apparatus made in accordance with the present invention.

The figures of the drawings disclose the preferred embodiment of a fuel/air flow control apparatus made in accordance with the present invention. The apparatus includes a base, or flange 12, which can be adapted to mate with most any base, or flange 14, associated with the intake manifold 16 of an internal combustion engine of the prior art. An air filter 18, which can take on several different forms, filters debris from the incoming combustion air. A fuel inlet 20 is connected to the illustrated pump which in turn is connected to a source of fuel T. Numeral 22 indicates a regulated outlet by which excess fuel is returned to the tank T.

Figure 2:
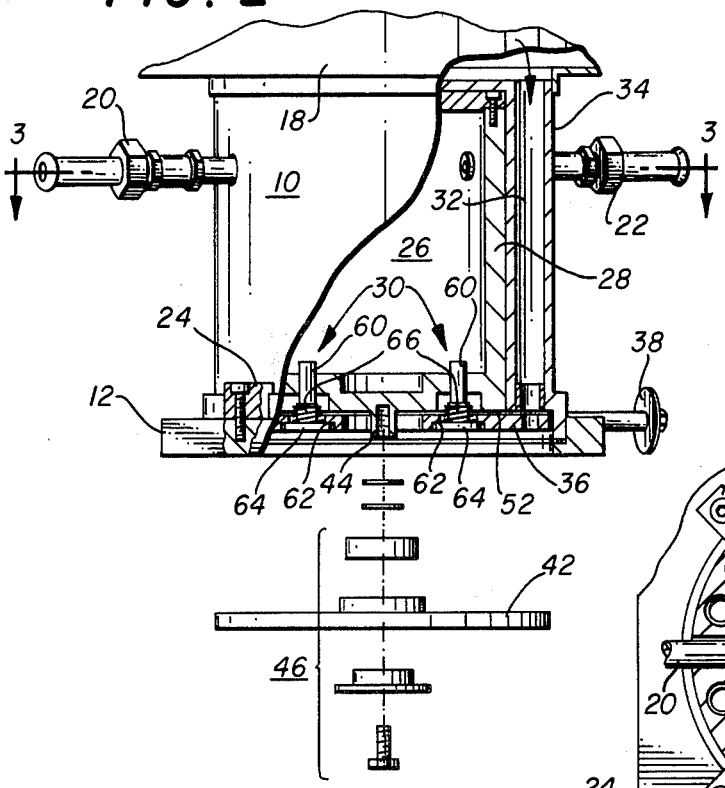
FIG. 2 is a part cross-sectional view of the apparatus disclosed in FIG. 1.
Figure 3:
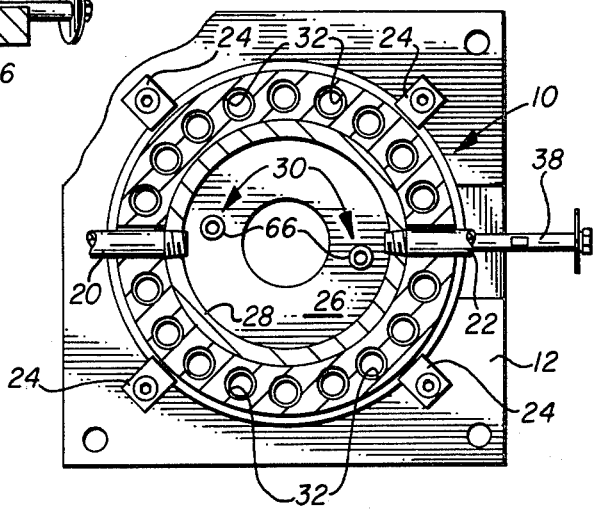
FIG. 3 is a cross-sectional view taken along line 3—3 of FIG. 2.
Figure 4:
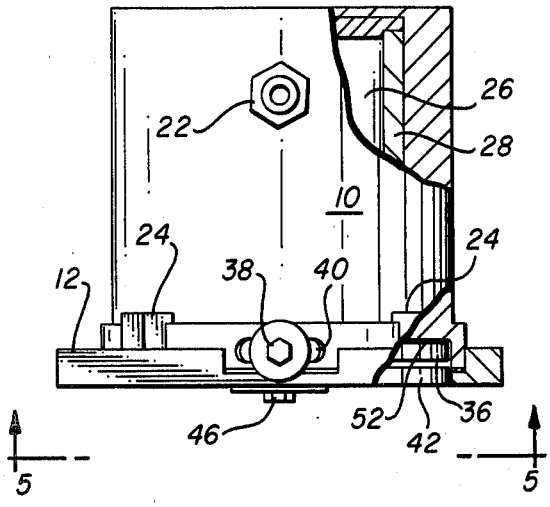
FIG. 4 is a side elevational view of an apparatus made in accordance with the present invention, with some parts thereof being removed therefrom, and some of the remaining parts being shown in cross-section.

In FIGS. 1–3, there is seen a clamp device 24 by which the fuel control housing is affixed to the before mentioned flange 12. As seen in FIGS. 2 and 3, the apparatus includes a chamber 26 formed by interior wall 28. Chamber 26 is connected to receive fuel at 20, and further includes fuel outlets 30 located in the bottom wall thereof.

A plurality of radially spaced apart air passageways are formed within an outer housing wall 34. The outer housing preferably is cylindrical in form, and the fuel tank walls 28 are concentrically arranged respective to the exterior wall 34.

A movable plate member 36 throttles the flow of fuel and air through the housing. The plate member is moved by a throttle lever 38, which can be connected to the foot operated throttle pedal of an automobile, for example. A crescent slot 40 is formed within the base 12 for receiving a lever 38 in such a manner that the lever can be moved parallel to the base 12 as the movable plate member is rotatably throttled between the opened and closed positions of operation.

Figure 5:
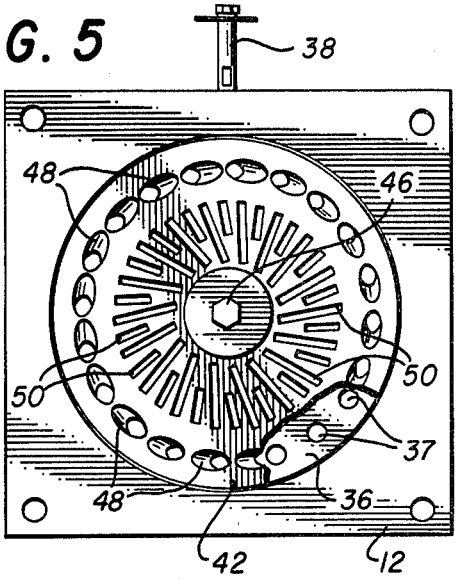
FIG. 5 is a bottom, part cross-sectional view looking in the direction indicated by the arrows at numeral 5—5 in FIG. 4.

As best seen in FIGS. 2 and 3, along with other figures of the drawings, a turbine wheel 42 can be journaled to a hub 44 by the illustrated bearings and nut assembly 46. As seen in FIG. 5, the turbine includes a plurality of angled passageways 48 which act as a vane, thereby imparting rotational motion into the turbine wheel when flow occurs therethrough.

Figure 6:
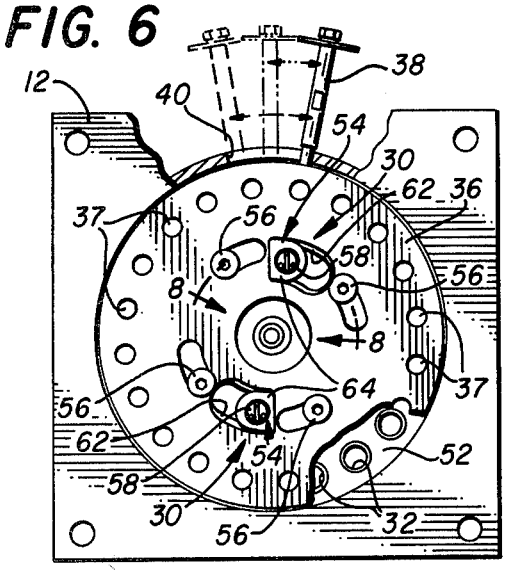
FIG. 6 is a bottom view of part of the apparatus disclosed in the foregoing figures, with some parts being broken away therefrom, and some of the remaining parts being shown in cross-section.
Figure 7:
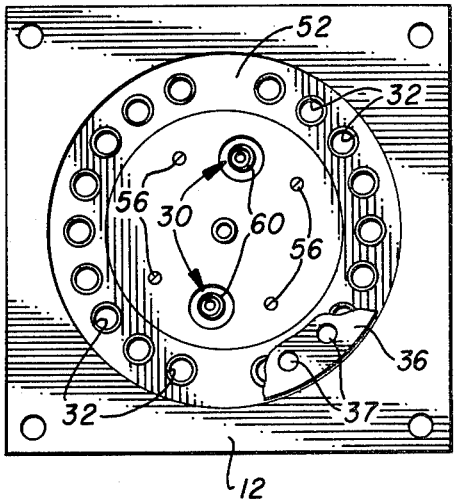
FIG. 7 is a bottom view of part of the apparatus shown in the foregoing figures.

As best seen in FIGS. 2 and 6, the bottom 52 of the fuel chamber abuttingly engages one face of the throttle plate, while the turbine wheel is slightly spaced from the lower face of the throttle plate and is concentrically arranged with respect to hub 44 and air passageways 32.

Figure 8:
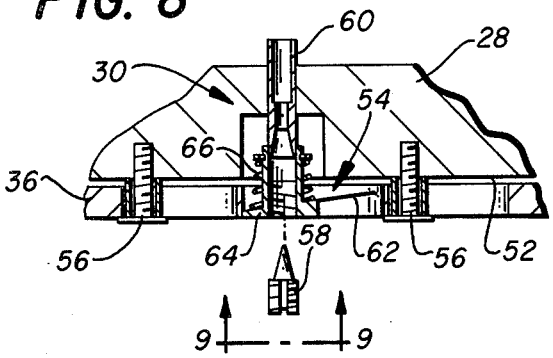
FIG. 8 is a fragmented, detailed illustration of part of the apparatus disclosed in the foregoing figures; and, FIG. 9 is a detail of part of the apparatus shown in FIG. 8, looking in the direction indicated by the arrows 9—9.
Figure 9:
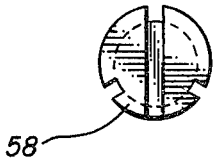

As seen in FIGS. 6 and 8, together with other figures of the drawings, a bushing and fastener means 56 captures the throttle plate to the lower face of member 52. A cam assembly 54 engages each of the spring loaded needle valves 58 and moves each of the valve elements towards and away from a fuel flow control valve seat 60.

Cam face 62 preferably is formed within the movable throttle plate member and includes a cam follower 64 which moves each needle valve 58 towards and away from the valve seat assembly 60. A spring 66 biases the needles 58 and the followers so that the followers always ride against the cam surface as the plate member is rotated from the opened to the closed position.

In operation, pump P forces fuel to flow from tank T towards the fuel inlet 20 and into the fuel chamber 26. Excess fuel is returned by the regulated outlet 22 back to the tank T. Movement of throttle lever 38 imparts rotational motion into the movable plate member 36. This action causes the cam means formed within the plate to engage the cam follower, which in turn moves the needle valve towards and away from the seat an amount which is proportional to the configuration of the cam surface.

Concurrently with the movement of lever 38, the ports 37 of the plate member are moved into registry with the outlet end of the passageway 32, so that the mass flow of air and the mass flow of fuel which flows through the valve means remains at a substantially constant ratio.

The air flows from the outlets 32, through ports 37, and impinges upon the turbine wheel where the air then flows through the turbine ports 48, thereby imparting rotational motion into the turbine wheel 42. Fuel flows from chamber 26, through outlet ports 30, through the needle valve seats 60, and impinges upon the radial vanes or slots 50 of the rotating turbine wheel. This action causes the liquid fuel to explode into a gas, so that the resultant fuel/air mixture is in the gaseous phase.

The external surface 34 of the main housing preferably is cylindrical in form, although it could be made into other configurations. The gas chamber 26 preferably is surrounded by the circumferentially spaced apart air passageways 32 so that the temperature of the fuel is maintained at a relatively low temperature, thereby obviating vapor lock and the like. The return of fuel at 22 also reduces the likelihood of the occurrence of vapor-locking in the system.

The apparatus of the present invention provides a fuel/air control which is relatively low in cost, increases the efficiency of combustion, and maintains a substantially constant fuel/air ratio. The apparatus can include a single valve assembly 30, or a plurality of valves as shown, as may be required in order to meter a finite quantity of fuel. The radial vanes 50 preferably are slanted in a manner similar to the vanes at 48 so that fuel and air flows through both sets of vanes and imparts rotational motion thereinto in proportion to the mass flow therethrough.

I claim:

1. Flow control apparatus for simultaneously controlling the rate of flow of a stream of fuel and a stream of air, and for mixing the streams of fuel and air together to form a combustible mixture, comprising:

a housing having an air inlet end and an air outlet end; a fuel inlet by which a supply of fuel can be connected to the flow control apparatus; a fuel chamber formed within said housing, said fuel chamber is connected to receive a flow of fuel from said fuel inlet, a valve means for controlling fuel flow from said chamber;

a plurality of individual air flow passageways radially spaced respective to one another and having opposed ends, with one end arranged to commence at said air inlet end and the other end arranged to terminate adjacent said air outlet end;

an apertured movable plate member mounted to move about the axial centerline thereof and respective to said housing, said plate member being operatively connected to engine accelerator linkage and movable from one to an alternate position, there being an aperture in said plate which is aligned with a flow passageway when the plate member is moved to said one position, the apertures of said plate being misaligned with said flow passageways when the plate member is moved to the alternant position to thereby reduce air flow through the passageways to a minimum;

said other end of said air passageways forms an outlet end which terminates in a common plane;

said plate member has a face thereof which lies parallel to the plane formed by the outlet ends of the air passageways and abuttingly engages the ends of the passageways to thereby control the flow of air therethrough as the apertures are moved into and out of alignment with the passageways;

a cam means formed on said plate for actuating said valve means, said valve means being actuated toward the open position proportional to the opening formed between the plate apertures and the air passageways so that the air/fuel ratio is maintained substantially constant.

2. The flow control apparatus of claim 1 wherein said fuel chamber is located along the longitudinal axial centerline of said housing, said air passageways are circumferentially spaced about the fuel chamber;

one side of said plate member simultaneously engages the outlet end of said passageways, and can be rotated to cause said apertures to be simultaneously aligned with said passageways.

3. The apparatus of claim 2 wherein said valve means includes a valve element seat, said cam means moves said valve element toward and away from said seat as said plate is moved in one and then the other direction.

4. The apparatus of claim 3 and further including a turbine wheel, wherein said turbine wheel includes a plurality of angled passageways which act as a vane, said angled passageways are positioned in underlying and aligned relationship respective to said air passageways;

and a plurality of angled slots arranged inwardly of said angled passageways and arranged radially respective to the axial centerline thereof;

said valve means is positioned in overlying relationship respective to said angled slots so that fuel flows from said valve means and onto said angled slots.

5. The apparatus of claim 1 and further including a turbine wheel;

said turbine wheel includes a plurality of angled passageways which act as a vane, said angled passageways are positioned in underlying and aligned relationship respective to said air passageways;

and a plurality of angled slots arranged inwardly of said angled passageways and arranged radially respective to the axial centerline thereof;

said valve means is positioned in overlying relationship respective to said angled vanes so that fuel flows from said valve means and onto said angled slots.

6. The apparatus of claim 1 and further including a turbine wheel mounted at the outlet end of the passageways for mixing the fuel and air which travel therethrough.

7. The apparatus of claim 1 wherein said plate member has a face thereof which lies parallel to the plane formed by the outlet ends of the air passageways and simultaneously abuttingly engages the outlet ends of the passageways to thereby control the flow of air therethrough as the apertures are moved into and out of alignment with the passageways;

and further including a turbine wheel mounted at the outlet end of the passageways for mixing the fuel and air which travel therethrough.

8. Fuel and air combustion mixture flow control apparatus comprising a housing, a fuel chamber formed within said housing, a fuel inlet flow path means connected to said fuel chamber, a fuel outlet port;

a plurality of air flow passageways formed through said housing, each having an inlet end opposed to an outlet end; said air passageways have an outlet end which terminates in a common plane;

a plate member has a surface which lies parallel to the plane formed by the outlet ends of the air passageways and abuttingly engages one end of the passageways to thereby control the flow of air therethrough as the apertures are moved into and out of alignment with the passageways;

said plate member being operatively connected to engine accelerator linkage and movable from an opened to a closed position; said plate member having spaced openings formed therein, there being one opening aligned with one passageway such that when the plate member is moved from the closed to the opened position, air flow through the passageway increases from a minimum to a maximum flow rate;

valve means connected between said plate member and said fuel outlet port for controlling the flow of fuel from a minimum to a maximum as the plate member is moved from a closed to an opened position;

said valve means is moved by a cam means formed on said plate, with the cam means and valve means being actuated toward the open position proportional to the opening formed between the plate and air passageways so that the air/fuel ratio is maintained substantially constant;

an outlet formed at one end of the housing for mixing the air and fuel into a combustible mixture.

9. The flow control apparatus of claim 8 wherein said fuel chamber is located along the longitudinal axial centerline of said housing, said air passageways are circumferentially spaced about the fuel chamber;

and further including a turbine wheel; said turbine wheel includes a plurality of angled passageways which act as a vane, said angled passageways are positioned in underlying and aligned relationship respective to said air passageways;

and a plurality of angled slots arranged inwardly of said angled passageways and arranged radially respective to the axial centerline thereof;

said valve means is positioned in overlying relationship respective to said angled slots so that fuel flows from said valve means and onto said angled slots.

* * * * *